United States Patent [19]

Olivieri

[11] 4,433,458

[45] Feb. 28, 1984

[54] QUICK-FASTENER FOR ROLLER SKATES

[75] Inventor: Icaro Olivieri, Montebelluna, Italy

[73] Assignee: Icaro Olivieri & C. S.p.A., Montebelluna, Italy

[21] Appl. No.: 272,724

[22] Filed: Jun. 11, 1981

[51] Int. Cl.[3] ..... A44B 11/00

[52] U.S. Cl. ..... 24/191

[58] Field of Search ..... 24/191, 16 PB, 22 T, 24/191, 19

[56] References Cited

U.S. PATENT DOCUMENTS 3,872,554 3/1975 Wolfentz et al. ..... 24/191

4,021,888 5/1977 Aimar ..... 24/16

4,229,862 10/1980 Kubelko ..... 24/170

*Primary Examiner*—Robert Peshock

*Attorney, Agent, or Firm*—Birch, Stewart, Kolasch & Birch

[57] ABSTRACT

A fastener for roller skates, which can be manipulated quickly and simply by young children while providing a secure attachment of a skate to a user's foot, comprises a band with transverse teeth which is fixed to the skate, and a spring pawl engageable with the teeth. The pawl is carried by a U-shaped support fixed to the skate in correspondence with the band.

6 Claims, 2 Drawing Figures

QUICK-FASTENER FOR ROLLER SKATES

BACKGROUND OF THE INVENTION

The present invention relates to a fastener for roller skates and, more particularly, to a fastener for roller skates for young or very young beginners.

It is well known that the fastening means fitted to roller skates must ensure that the best possible attachment of each skate to the foot and/or footwear of the user and must also be so constructed as to be simple and quick to manipulate. Moreover, it is well known that this second requirement, which is felt particularly when the users of the roller skates are young or very young beginners, is clearly in contrast with the necessity for an especially efficient fixing, so much so that prior fasteners have frequently been only compromise solutions.

OBJECT OF THE INVENTION

The object of this invention is to provide a fastener which, as well as being particularly easy to manipulate, even by inexpert hands such as children's, will also have structural characteristics which ensure a more than satisfactory securing of the skate to the foot and/or footwear of the user.

SUMMARY OF THE INVENTION

According to the present invention, there is provided a quick-fastener for roller skates comprising a band which is provided on one of its faces with transverse teeth of substantially saw-tooth type, a spring pawl carried by a substantially U-shaped support, and means for fixing the band and the support to a skate.

BRIEF DESCRIPTION OF THE DRAWINGS

A preferred embodiment of the invention will now be described, by way of example, with reference to the attached drawings, in which.

DETAILED DESCRIPTION OF THE PREFERRED EMBODIMENT

Figure 2:
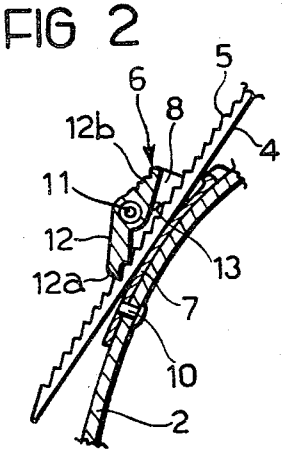
FIG. 2 is a section taken along the line II—II of FIG. 1.
Figure 1:
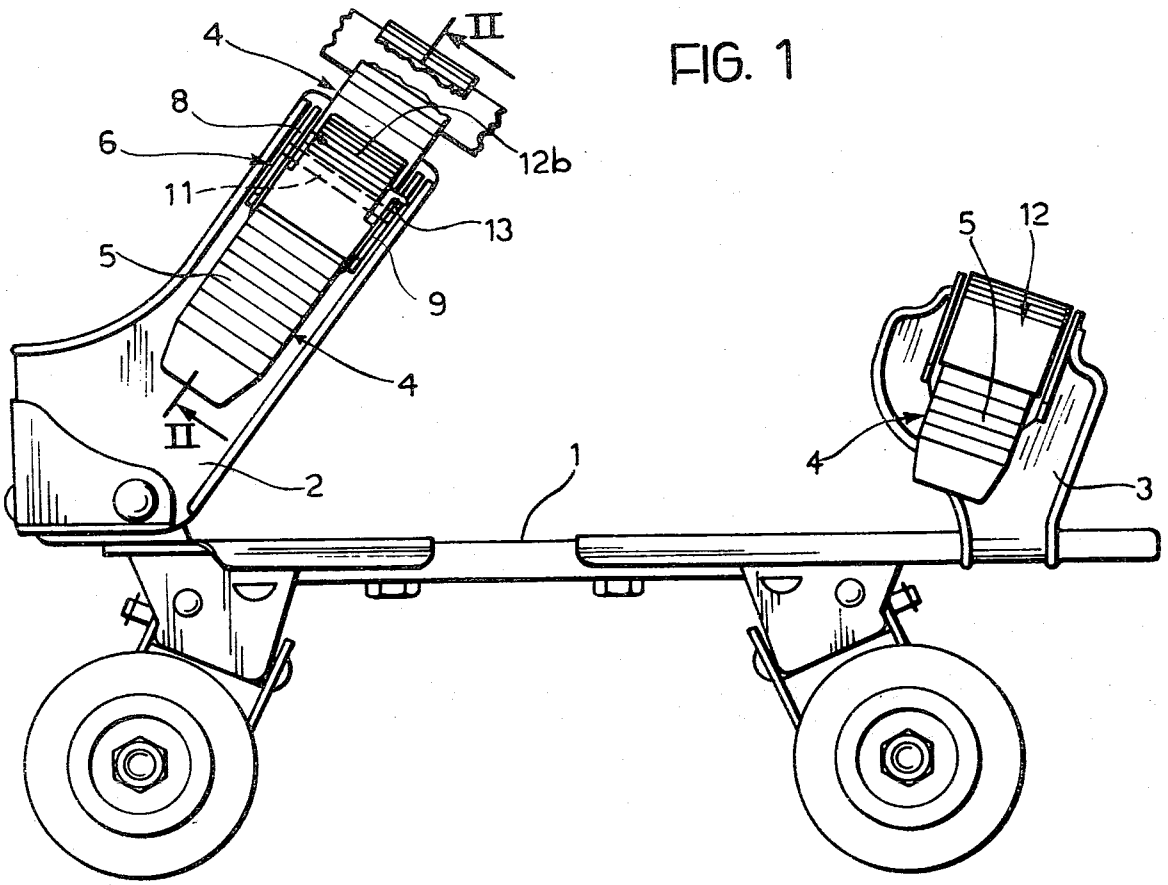
FIG. 1 is a side view of a roller skate fitted with quick fasteners according to the invention.

Referring to FIG. 1, there is shown, by way of example, a roller skate 1 of the type specially designed for young and very young beginners. This skate 1 is equipped, in both rear and front positions in the conventional manner, with straps 2,3 of suitably strong and flexible material, which are intended to be fastened over the instep and toes, respectively, of the user's foot. To this end, both the rear and front straps 2,3 are provided with quick fasteners according to this invention. Only one of the fasteners will be described below.

A fastener according to the invention comprises a band 4 of suitably strong and flexible material, which has transverse teeth 5 of the substantially saw-tooth type. This band is fixed by conventional means, such as riveting, not shown, in a predetermined position on the strap 2. Generally indicated 6 is a substantially U-shaped support on which can be seen a base plate 7 and two wings or side panels 8,9. The base plate 7 is intended to be fixed by traditional means, such as rivets 10, in a predetermined position on the strap 2. The wings 8,9 of the support 6 carry, on a pin 11, a pawl lever 12 which has an active end **12*a* adapted to engage the saw teeth of the band 4, and a knurled part 12*b* to facilitate its manipulation. A spring 13 on the pin 11 has respective ends engaged with the pawl 12 and one wing 9 of the support 6. This spring resists the disengagement of the active end 12*a* of the pawl 12 from the teeth of the band 4. The position of the pin 11 on the wings 8,9 of the support 6, and the shape or section of the pawl 12, are chosen so that an opening is defined between the pawl and the base plate 7 of the support, to allow the introduction and through passage of the band 4**.

From what has been described and illustrated, it is evident that the fastener of this invention will be particularly easy and quick to manipulate, even by young or very young users, whilst nevertheless ensuring a more than satisfactory attachment of the skate to the foot or the footwear of the user.

What is claimed is:

1. A quick fastener for a roller skate comprising:

a band adapted to be affixed to the roller skate;

said band being provided on one face with transverse saw-teeth;

a substantially U-shaped rigid support member adapted to be affixed to one side of the roller skate in operative relationship relative to the band; and a spring pawl being outwardly exposed and operatively affixed to the substantially U-shaped support and including an active end biased toward the substantially U-shaped support for engaging the transverse saw-teeth of said band;

said spring pawl further including a knurled part displaceable relative to said active part and being manually engageable for displacing said active part away from said substantially U-shaped support;

wherein when said band is disposed between the substantially U-shaped support and the spring pawl said active end automatically engages the transverse saw-teeth and said band is lockingly engaged relative to said U-shaped support and upon manually biasing said active end of said spring pawl away from said substantially U-shaped support said active end disengages from said band to permit the release of said band from said substantially U-shaped support.

2. A quick fastener according to claim 1, wherein said substantially U-shaped support includes wings disposed at each side thereof defining a path to guide the alignment and insertion of said band.

3. A quick fastener according to claim 2, wherein said spring pawl includes a spring member being in engagement with at least one of said wings and said spring pawl to bias said active end toward the substantially U-shaped support.

4. A quick fastener according to claim 2, and further including a base plate being affixed to said substantially U-shaped support.

5. A quick fastener according to claim 2, and further including a pin operatively positioned through said wings, said spring pawl being pivotally mounted on said pin for movement relative to said substantially U-shaped support.

6. A quick fastener according to claim 1, wherein two bands and two substantially U-shaped supports are positioned on said roller skate, one being adjacent a toe portion and the second being adjacent a heel portion of an individual user's foot.

* * * * *

UNITED STATES PATENT AND TRADEMARK OFFICE

CERTIFICATE OF CORRECTION

PATENT NO. : 4,433,458

DATED : February 28, 1984

INVENTOR(S) : Icaro OLIVIERI

It is certified that error appears in the above-identified patent and that said Letters Patent is hereby corrected as shown below:

In the Heading of the Patent, after the category "[22] Filed", insert

--[30] Foreign Application Priority Data

Jan. 14, 1981 [IT] Italy.....20472 B/81--

Signed and Sealed this

Fifth Day of June 1984

[SEAL]

Attest:

GERALD J. MOSSINGHOFF

Attesting Officer

Commissioner of Patents and Trademarks